US008112834B1

(12) United States Patent
Shamie et al.

(10) Patent No.: US 8,112,834 B1
(45) Date of Patent: Feb. 14, 2012

(54) CONNECTING ARRANGEMENT FOR SPRING DECK HOLDER FOR A CRIB MATTRESS

(75) Inventors: Sam I. Shamie, Brooklyn, NY (US); Francisco J. Reyes, Brooklyn, NY (US)

(73) Assignee: Delta Enterprise Corp., New York, NY (US)

( * ) Notice: Subject to any disclaimer, the term of this patent is extended or adjusted under 35 U.S.C. 154(b) by 270 days.

(21) Appl. No.: 12/434,204

(22) Filed: May 1, 2009

(51) Int. Cl.
*A47D 7/00* (2006.01)

(52) U.S. Cl. ..... 5/93.1; 5/207; 5/299

(58) Field of Classification Search ..... 5/11, 93.1, 5/100, 101, 412, 200.1, 201, 285, 207, 299; 403/254, 316, 319, 324; 248/221.12, 222.41, 248/243

See application file for complete search history.

(56) References Cited

U.S. PATENT DOCUMENTS 3,537,115 A 11/1970 Gordin
3,646,622 A 3/1972 Van Riper, Jr.
3,760,434 A 9/1973 Neunherz et al.
4,639,956 A 2/1987 Shamie
4,744,114 A 5/1988 Simpson et al.
4,825,482 A 5/1989 Paris
4,951,330 A 8/1990 Burnham
5,361,432 A * 11/1994 Shamie ..... 5/11
7,128,493 B2 * 10/2006 Alarcon-Lopez ..... 403/322.1

* cited by examiner

*Primary Examiner* — Robert G Santos
*Assistant Examiner* — Nicholas Polito
(74) *Attorney, Agent, or Firm* — Richard M. Goldberg

(57) ABSTRACT

A connecting arrangement for connecting a mattress support to supporting sides of a crib, includes stationary bars secured to the supporting sides, each having a first opening; slide bars, each having a second opening and mounted in sliding relation to a stationary bar between first and second positions in which the first and second openings are in or out of alignment with each other; a third opening in the slide bar and being in open communication with the second opening, the third opening being smaller than the second opening; and arms, each having one end connected to the mattress support and an opposite free end having a pin with an enlarged head for engagement within the first and second openings when the slide bar is moved to the first position and which is locked in the third opening when the slide bar is moved to the second position.

20 Claims, 11 Drawing Sheets

FIG. 8
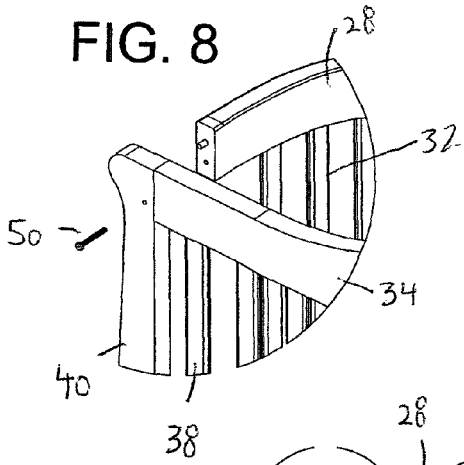
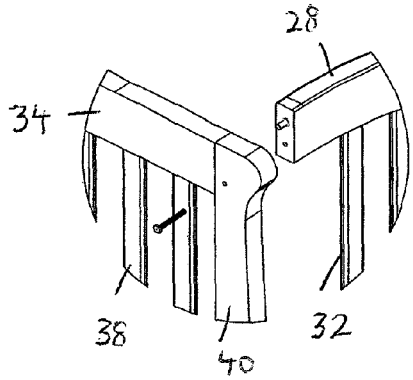
FIG. 9
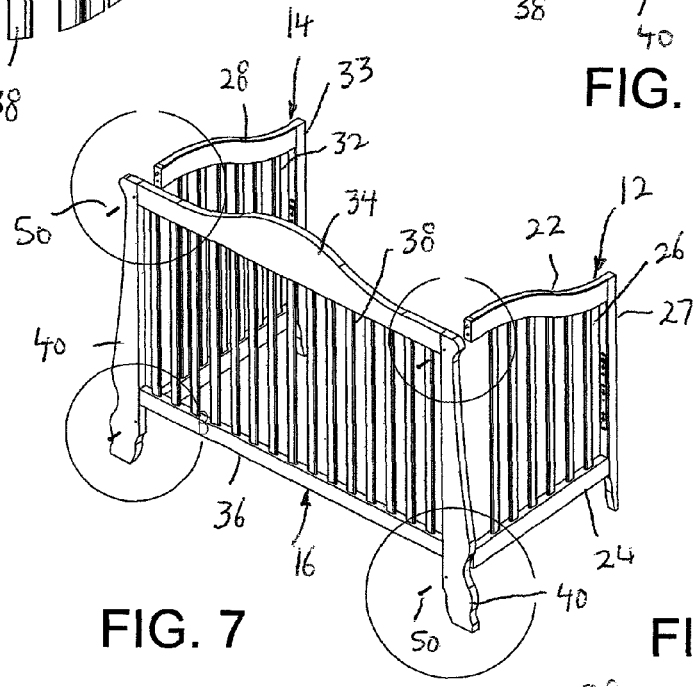
FIG. 7
FIG. 11
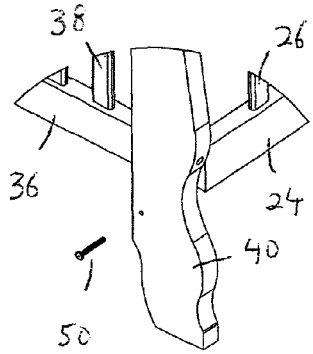
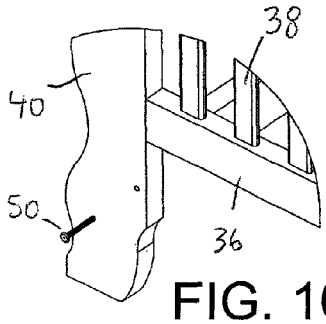
FIG. 10

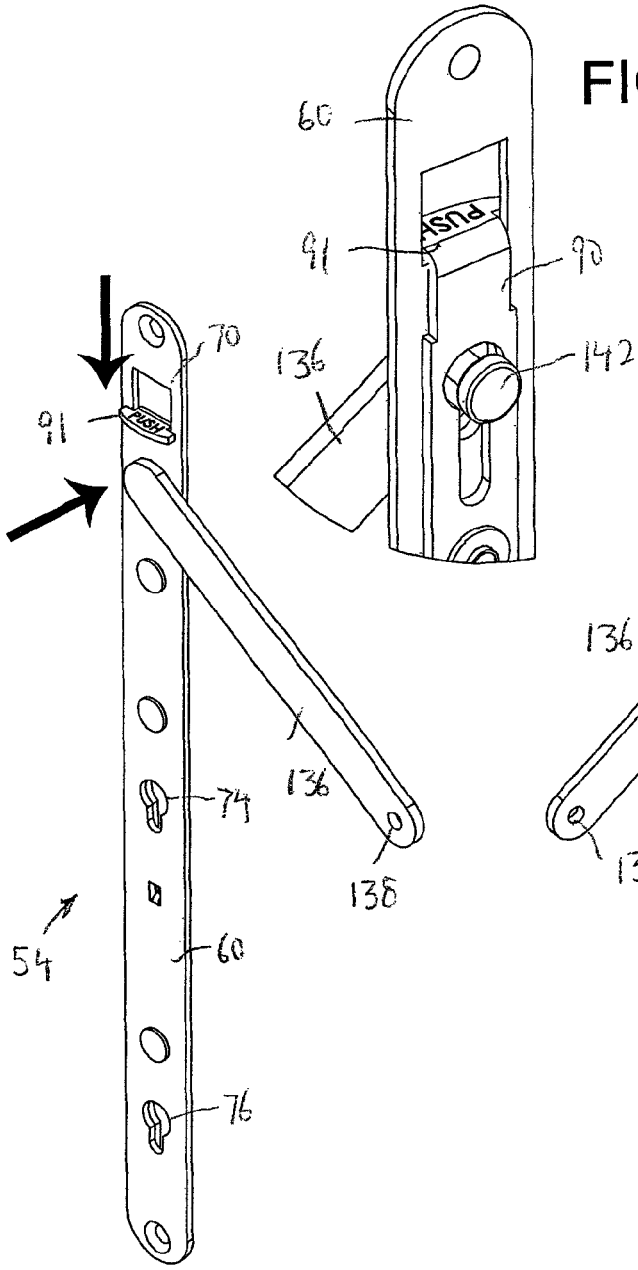
FIG. 24
FIG. 26
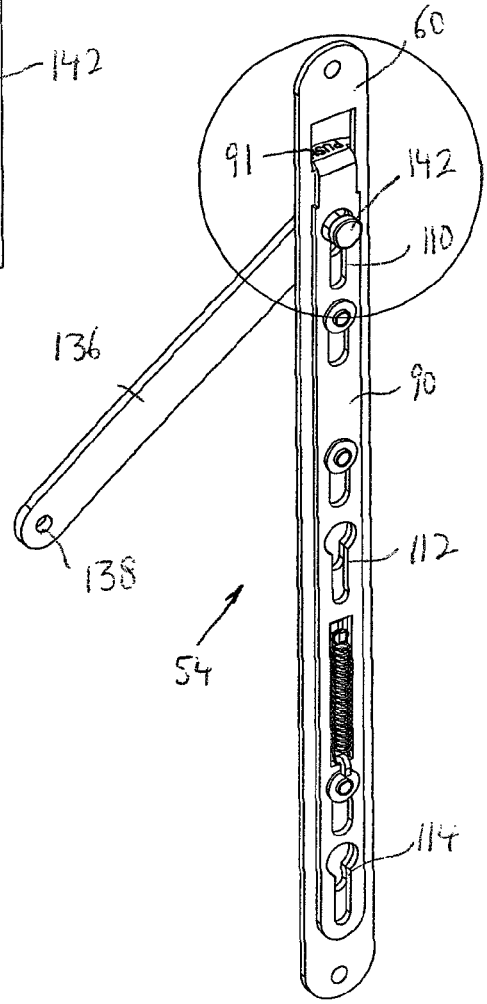
FIG. 25

CONNECTING ARRANGEMENT FOR SPRING DECK HOLDER FOR A CRIB MATTRESS

BACKGROUND OF THE INVENTION

The present invention relates generally to infant cribs, playpens or the like, and more particularly, is directed to a mattress support for an infant crib, playpen or the like.

Normally, the mattress support or spring deck holder of a crib includes hanger arms for hanging the spring deck. The mattress is then placed on top of the spring deck holder. Each hanger arm is provided with a hole through which a screw passes in order to attach the spring deck holder to the corner posts of a crib. Many other arrangements use an insert nut, which is a fitting that is screwed into the corner post and has a center as a thread to receive a bolt. Another prior art arrangement screws a steel plate onto the corner post over a hollowed-out area, in which the plate has multiple holes that are threaded to receive a bolt from the hanger arms.

In all of these arrangements, screws or bolts are required to secure the hanger arms to the corner posts of the crib. This is disadvantageous from an assembly standpoint, making the assembly more complex and difficult, and requiring tools to assemble the same. In addition, the extra parts of the screws and bolts make the construction more costly, and further, there is a likelihood that the screws or bolts become lost when the crib is disassembled and stored away. In addition, there is the possibility over time that the screws tend to loosen, lessening the structural integrity of the crib.

SUMMARY OF THE INVENTION

Accordingly, it is an object of the present invention to provide a spring deck holder for a crib mattress that overcomes the aforementioned deficiencies.

It is another object of the present invention to provide a spring deck holder for a crib mattress that eliminates the use of screws or bolts in the assembly thereof.

It is still another object of the present invention to provide a spring deck holder for a crib mattress that is easy to assemble.

It is yet another object of the present invention to provide a spring deck holder for a crib mattress which does not require any tools for assembly thereof.

It is a further another object of the present invention to provide a spring deck holder for a crib mattress that provides good structural support for the mattress.

It is a still further another object of the present invention to provide a spring deck holder for a crib mattress that is safer to use since it eliminates the possibility of consumer assembled screws loosening up.

In accordance with an aspect of the present invention, a connecting arrangement for connecting a mattress support to supporting sides of a crib, includes a plurality of stationary bars secured to a plurality of the supporting sides, respectively, each stationary bar having a first opening, and a plurality of slide bars, each slide bar having a second opening and each slide bar being mounted in sliding relation to a respective stationary bar between a first position in which the first and second openings are in alignment with each other and a second position in which the first and second openings are out of alignment with each other. A third opening is provided in either the stationary bar or slide bar and is in open communication with the first or second opening, the third opening being smaller than the respective first or second opening. A plurality of arms are provided, each arm having one end connected to the mattress support and an opposite free end having a pin with an engaging end for engagement within respective first and second openings when the respective slide bar is moved to the first position and which is locked in the third opening when the respective slide bar is moved to the second position.

A spring is connected between each respective stationary bar and slide bar for biasing each slide bar to the second position.

The third opening is provided in the slide bar in open communication with the second opening.

There are a plurality of the first openings in each stationary bar, and a plurality of the second openings in each slide bar, with a plurality of the third openings, each third opening in open communication with a respective one of the first and second openings.

There is also a fourth opening in the other of the respective stationary bar and slide bar and being in open communication with the respective other of the first and second openings, the fourth opening being smaller than the respective other of the first and second openings.

A securement assembly secures together each respective stationary bar and slide bar in a manner to permit each slide bar to move in a sliding relation to the respective stationary bar. The securement assembly includes at least one elongated slot in one of the stationary bar and slide bar, and a rivet which is secured to the other of the stationary bar and slide bar and extends into the at least one elongated slot in one of the stationary bar and slide bar.

One end of each arm is pivotally connected to the mattress support.

Each slide bar further includes a tab for moving the slide bar relative to the respective stationary bar. Each stationary bar includes a fourth opening, and the tab of the respective slide bar extends through the fourth opening. Each slide bar is positioned behind the respective stationary bar.

In accordance with another aspect of the present invention, a crib includes a headboard; a footboard; first and second side rails connected in parallel, spaced apart relation between the headboard and the footboard; four vertical posts for supporting the crib and connected to four corners of the crib at interconnections of the footboard and headboard with the side rails; and a mattress support for supporting a mattress between the headboard, footboard and side rails. A connecting arrangement connects a mattress support to the vertical posts of the crib. The connecting arrangement includes a plurality of stationary bars secured to the vertical posts, each stationary bar having a first opening, and a plurality of slide bars, each slide bar having a second opening and each slide bar being mounted in sliding relation to a respective stationary bar between a first position in which the first and second openings are in alignment with each other and a second position in which the first and second openings are out of alignment with each other. A third opening is provided in one of a respective stationary bar and slide bar and being in open communication with a respective one of the first and second openings, the third opening being smaller than the respective one of the first and second openings. A plurality of arms are provided, each arm having one end connected to the mattress support and an opposite free end having a pin with an engaging end for engagement within respective first and second openings when the respective slide bar is moved to the first position and which is locked in the third opening when the respective slide bar is moved to the second position.

The above and other objects, features and advantages of the invention will become readily apparent from the following detailed description thereof which is to be read in connection with the accompanying drawings.

BRIEF DESCRIPTION OF THE DRAWINGS

FIG. 7 is a rear perspective view showing assembly of the rear stationary side rail to the headboard and footboard;

FIG. 8 is an enlarged view of one upper corner of FIG. 7;

FIG. 9 is an enlarged view of the other upper corner of FIG. 7;

FIG. 10 is an enlarged view of one lower corner of FIG. 7;

FIG. 11 is an enlarged view of the other lower corner of FIG. 7;

FIG. 24 is a front perspective view of the arrangement for securing the spring deck to the crib, with the push tab pushed down;

FIG. 25 is a rear perspective view of the arrangement for securing the spring deck to the crib, with the push tab pushed down;

FIG. 26 is an enlarged rear perspective view of the upper end of the arrangement for securing the spring deck to the crib, with the push tab pushed down;

DETAILED DESCRIPTION

Figure 2:
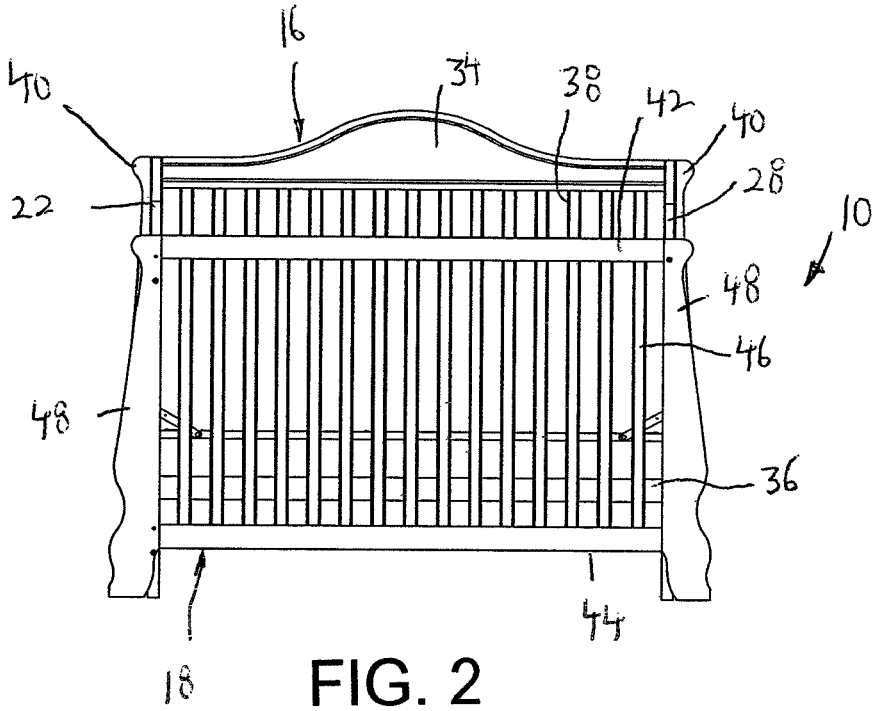
FIG. 2 is a front elevational view of the crib of FIG. 1.
Figure 1:
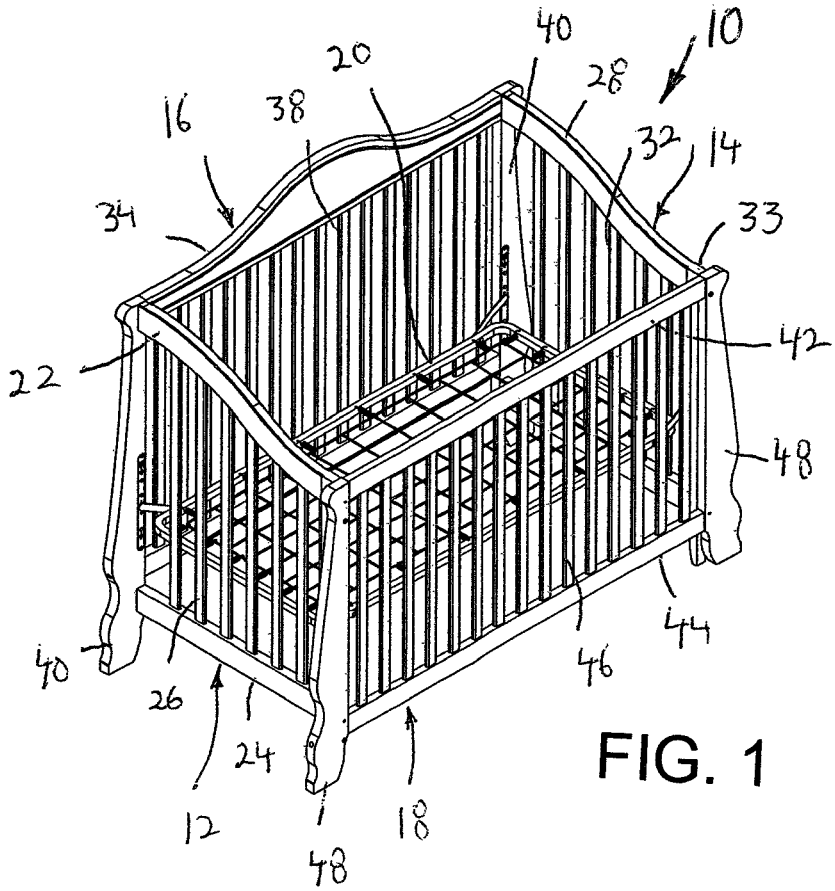
FIG. 1 is a front perspective view of the crib according to the present invention, with two stationary side rails.
Figure 3:
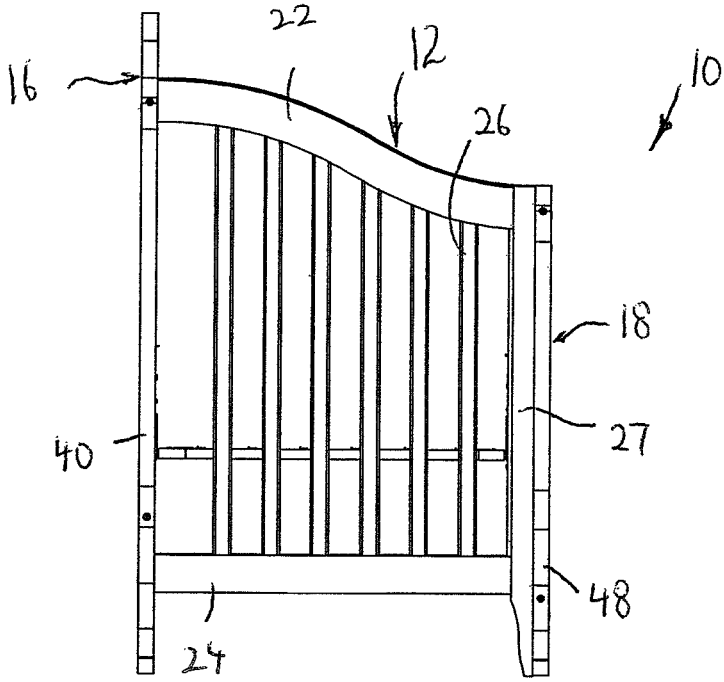
FIG. 3 is a left side elevational view of the crib of FIG. 1.
Figure 4:
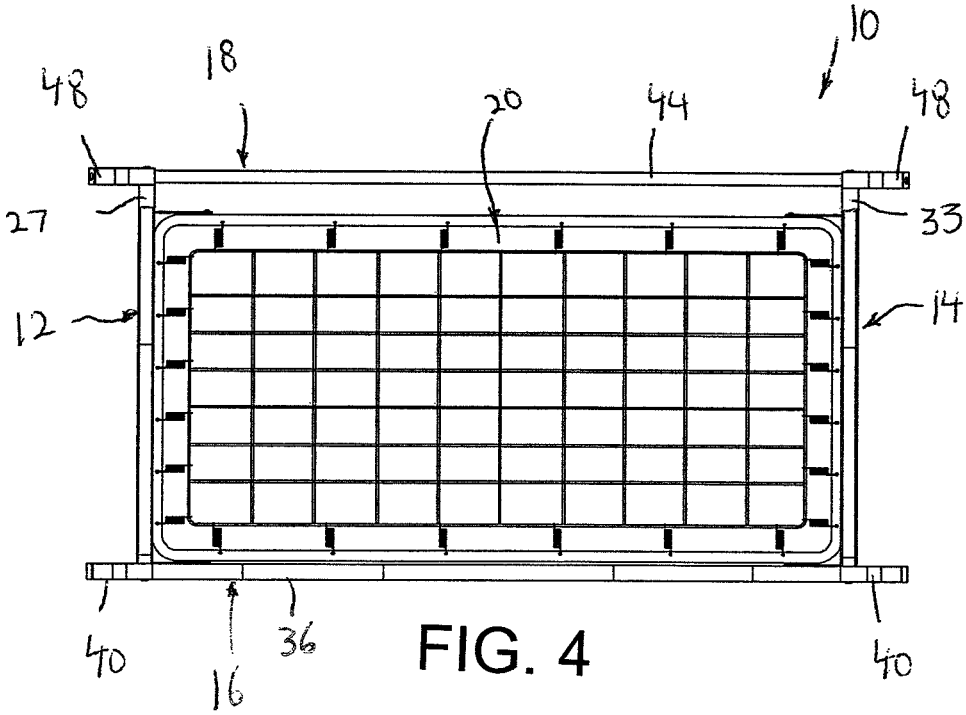
FIG. 4 is a bottom plan of the crib of FIG. 1.
Figure 5:
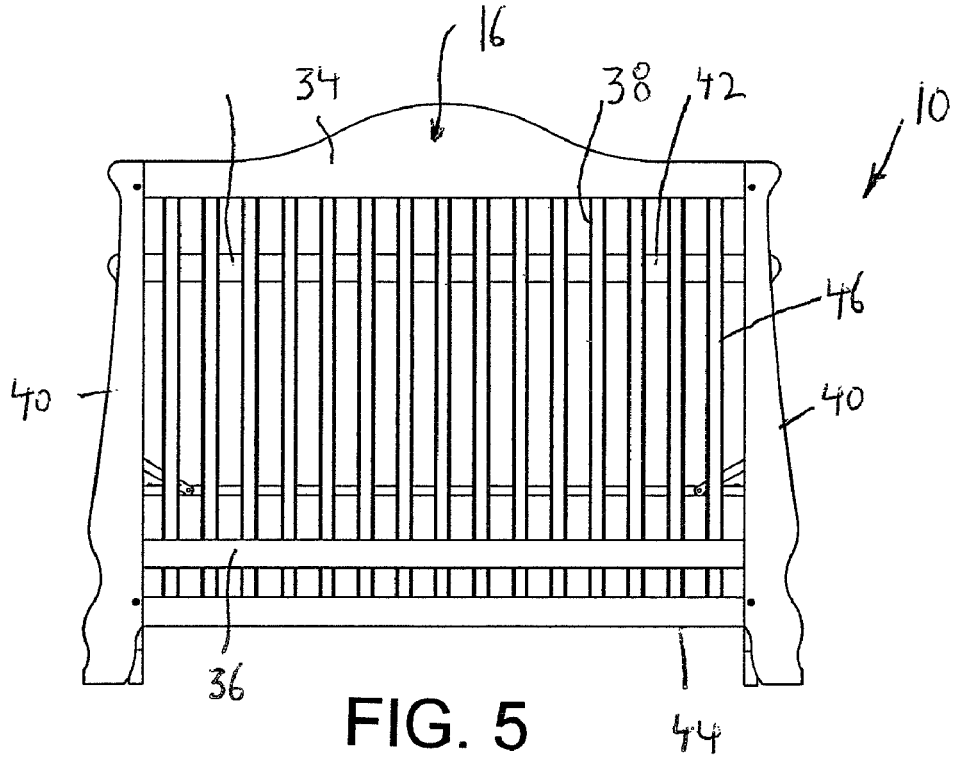
FIG. 5 is a rear elevational view of the crib of FIG. 1.
Figure 6:
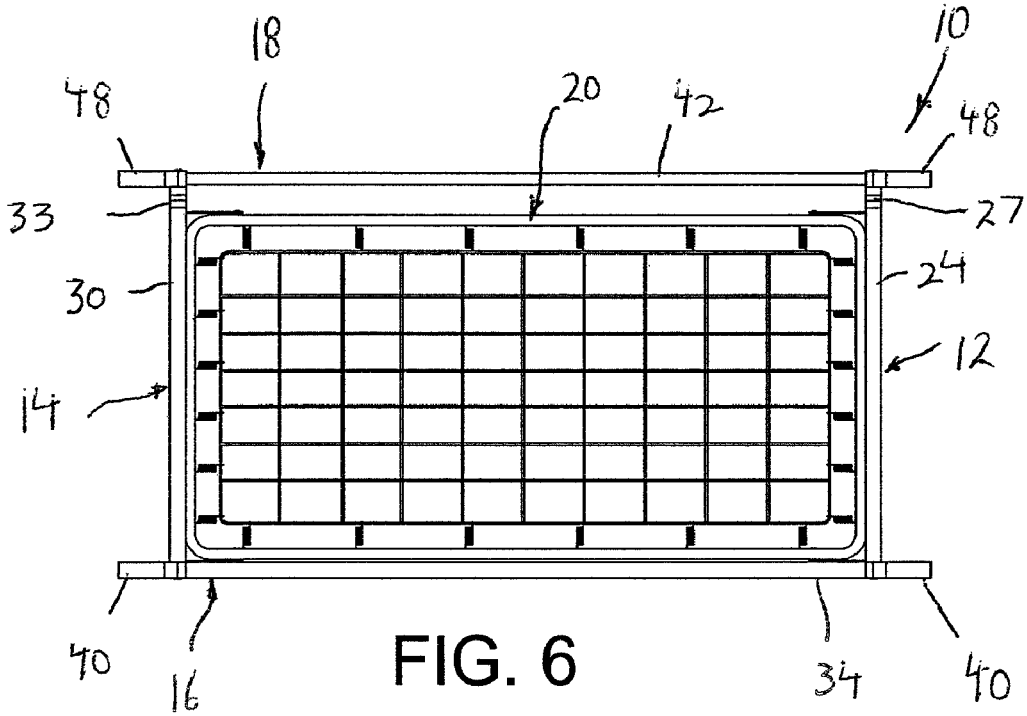
FIG. 6 is a top plan view of the crib of FIG. 1.

Referring to the drawings in detail, and initially to FIGS. 1-6 thereof, a crib 10 according to the present invention includes a headboard 12 and a footboard 14 connected together in a parallel, spaced apart relation to each other. Headboard 12 and footboard 14 are connected together by stationary side rails 16 and 18, and a spring deck 20 is mounted within the area enclosed by headboard 12, footboard 14 and stationary side rails 16 and 18 for supporting a mattress (not shown) thereon. A drop side rail can also be used with the present invention in place of one or both of the stationary side rails 16 and 18.

Headboard 12 is formed by a horizontally oriented upper cross brace 22 and a horizontally oriented lower cross brace 24, connected together by a plurality of equidistantly spaced apart vertical slats or rods 26. A vertical post 27 connects one end of upper cross brace 22 and lower cross brace 24. In like manner, footboard 14 is formed by a horizontally oriented upper cross brace 28 and a horizontally oriented lower cross brace 30, connected together by a plurality of equidistantly spaced apart vertical slats or rods 32. A vertical post 33 connects one end of upper cross brace 28 and lower cross brace 30.

Stationary side rail 16 includes an upper rail member 34 and a substantially parallel, spaced apart lower rail member 36 connected together by plurality of equidistantly spaced apart vertical slats or rods 38. Two vertical corner posts 40 connect ends of upper and lower rail members 34, 36, and function as two of the supporting legs of crib 10. In like manner, stationary side rail 18 includes an upper rail member 42 and a substantially parallel, spaced apart lower rail member 44 connected together by plurality of equidistantly spaced apart vertical slats or rods 46. Two vertical corner posts 48 connect ends of upper and lower rail members 42, 44, and function as the other two supporting legs of crib 10.

Alternatively, corner posts 27, 33 can be formed as part of stationary side rail 18, and/or corner posts 40 can be formed at the opposite ends of headboard 12 and footboard 14.

Figure 13:
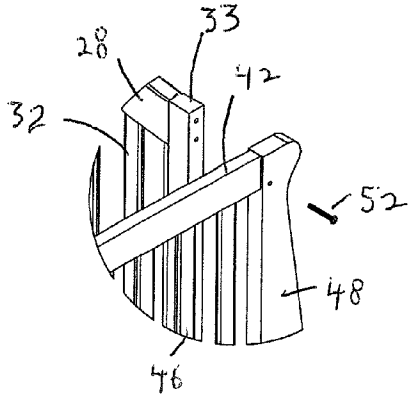
FIG. 13 is an enlarged view of one upper corner of FIG. 12.
Figure 14:
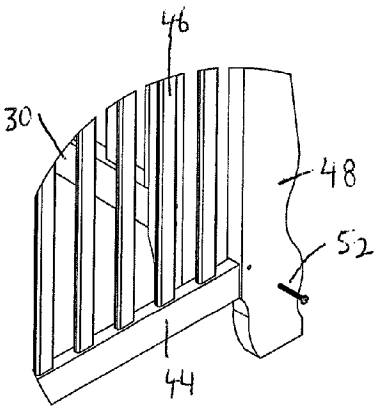
FIG. 14 is an enlarged view of one lower corner of FIG. 12.
Figure 12:
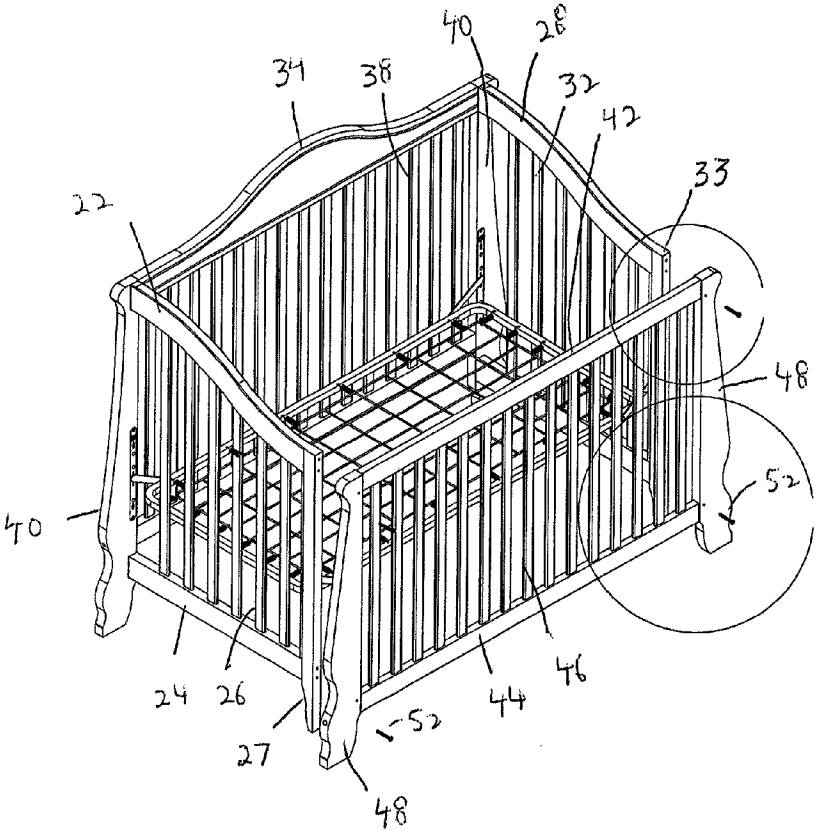
FIG. 12 is a front perspective view showing assembly of the front stationary side rail to the headboard and footboard.

To assemble crib 10, the free ends of upper cross braces 22, 28 and lower cross braces 24, 30 are secured to corner posts 40 of stationary side rail 16, by screws 50, as shown in FIGS. 7-11. Then, spring deck 20 is assembled therewith in the manner described in detail hereinafter. Thereafter, corner posts 48 are positioned flush against vertical posts 27, 33 and connected thereto by screws 52, as shown in FIGS. 12-14.

Figure 15:
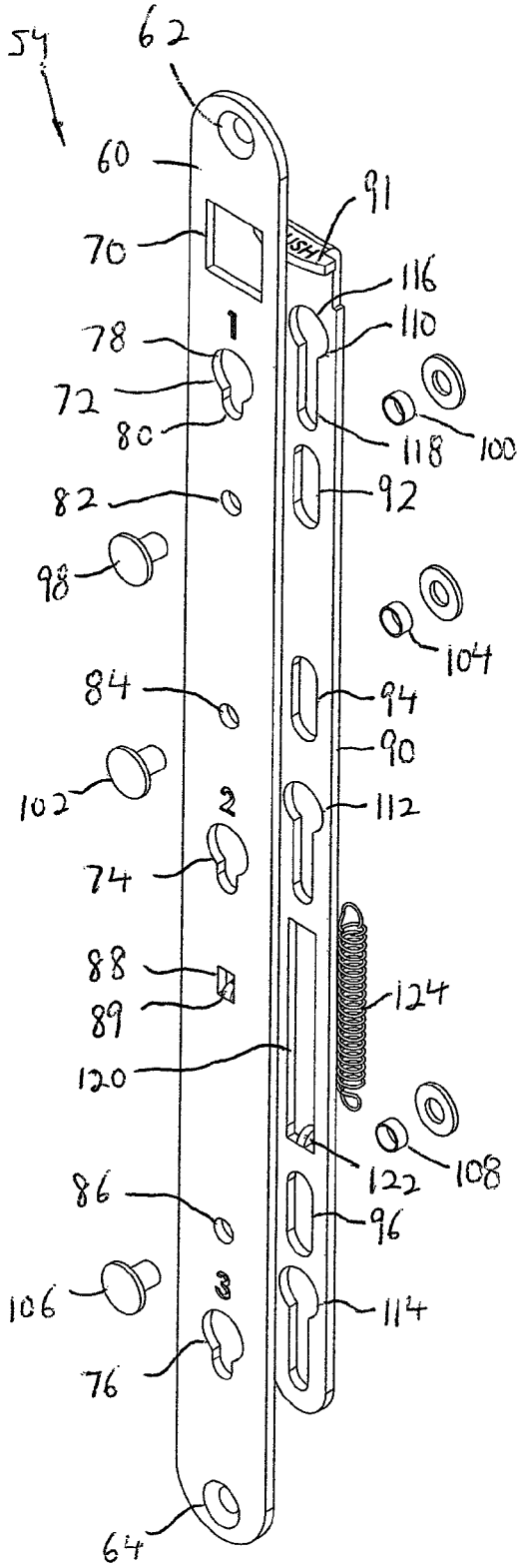
FIG. 15 is an exploded, front perspective view of the arrangement for securing the spring deck to the crib.
Figure 16:
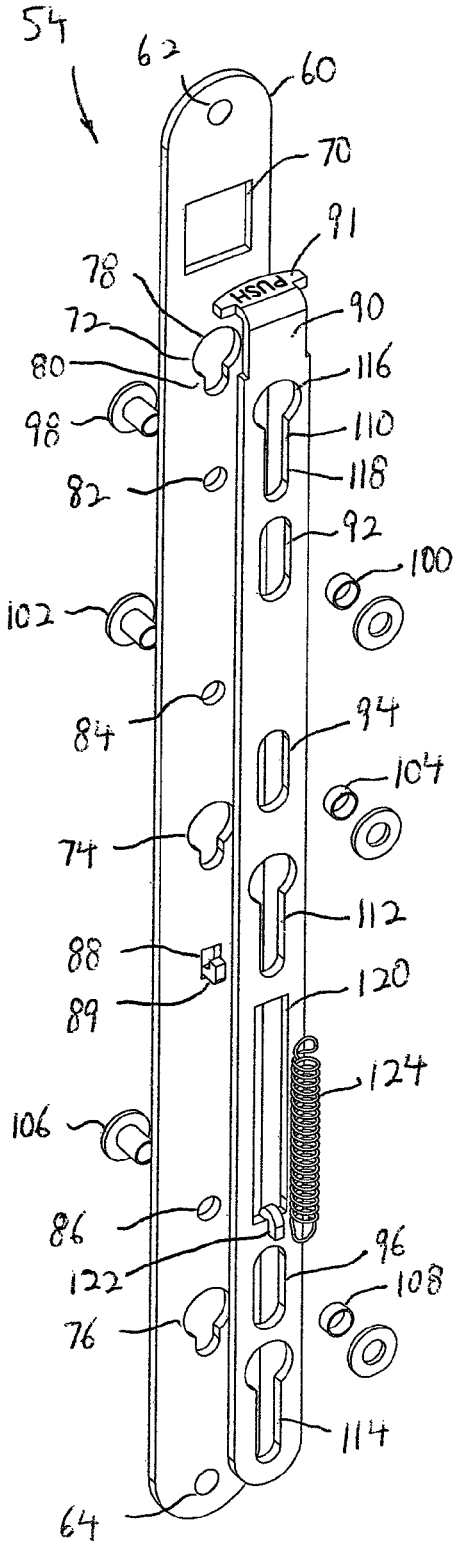
FIG. 16 is an exploded, rear perspective view of the arrangement for securing the spring deck to the crib.
Figure 18:
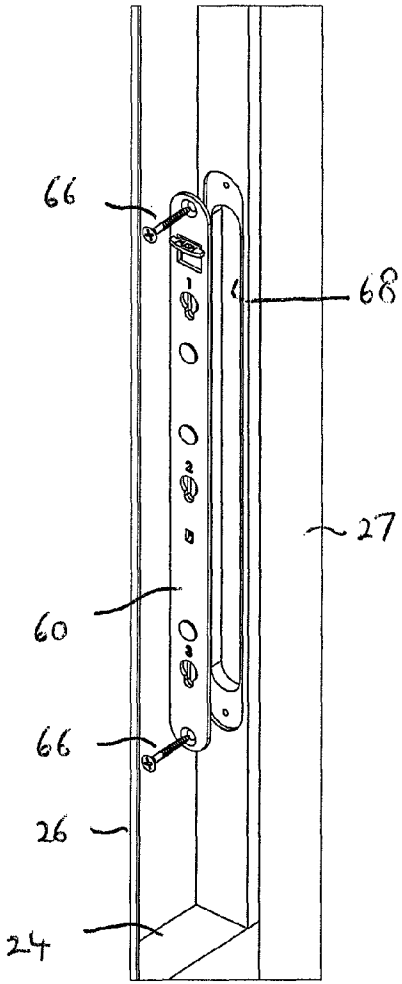
FIG. 18 is an enlarged perspective view showing the assembly of the spring deck securing arrangement to the vertical post of the headboard.
Figure 17:
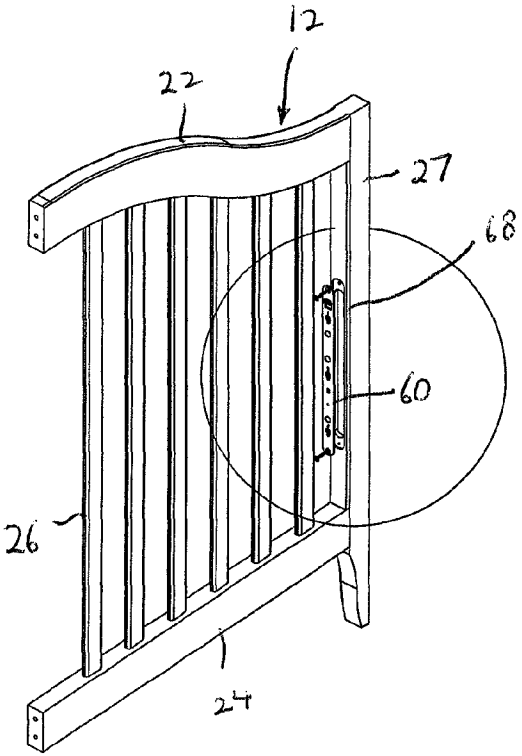
FIG. 17 is a perspective view showing the assembly of the spring deck securing arrangement to the vertical post of the headboard.
Figures 19, 20, 21:
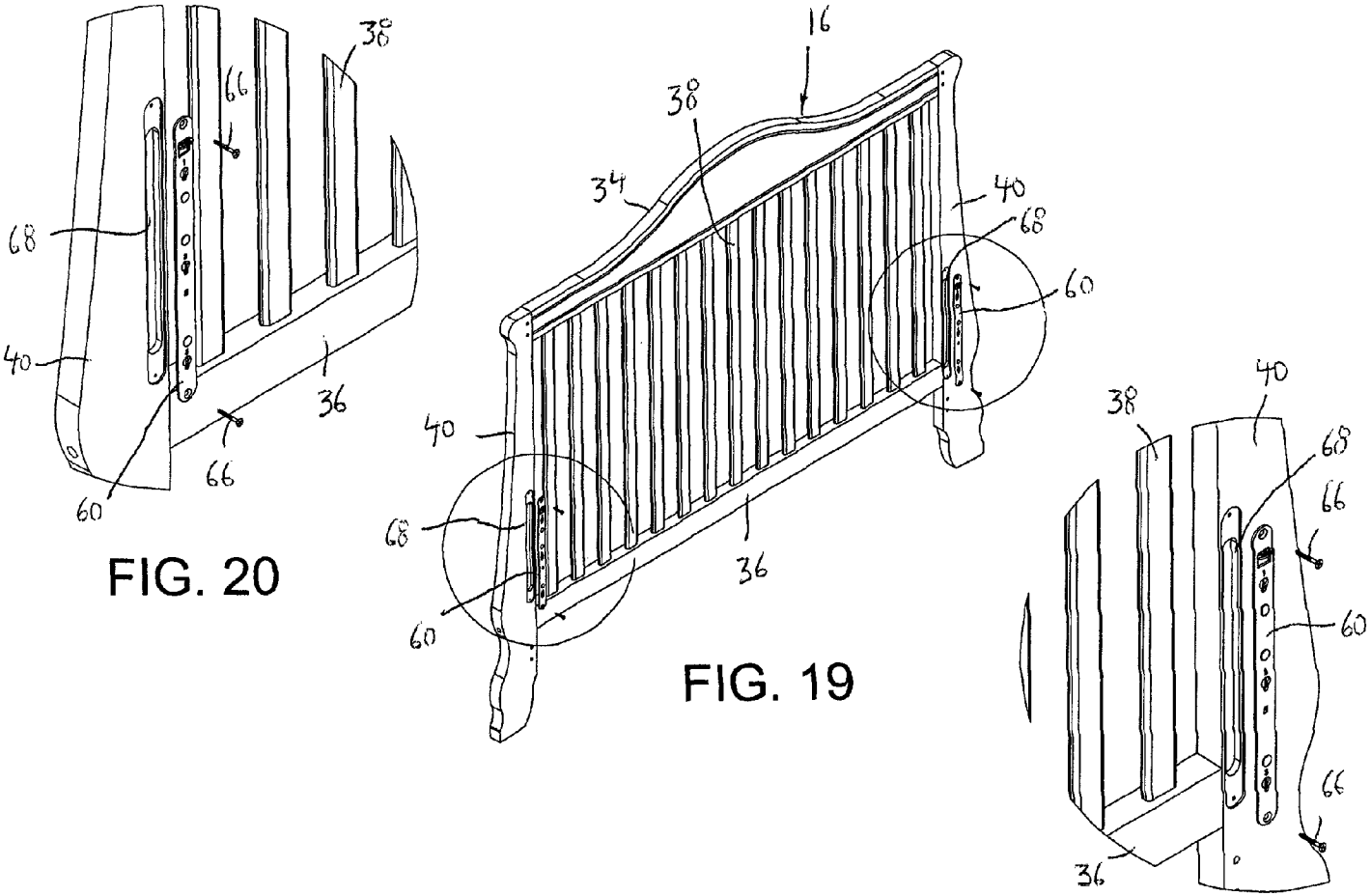
FIG. 19 is a perspective view showing the assembly of the spring deck securing arrangement to the corner posts of the rear stationary side rail.
FIG. 20 is an enlarged perspective view showing the assembly of the spring deck securing arrangement to one vertical post of the rear stationary side rail.
FIG. 21 is an enlarged perspective view showing the assembly of the spring deck securing arrangement to the other vertical post of the rear stationary side rail.

Referring now to FIGS. 15 and 16, the arrangement 54 for securing spring deck 20 to crib 10, includes an elongated flat stationary bar 60 having an upper opening 62 and a lower opening 64 by which it can be secured via screws 66 at the factory to a corner post 40, vertical post 27 or vertical post 33 of crib 10, preferably within a shallow recess 68 therein, as shown best in FIGS. 17-21. Bar 60 includes a square opening 70 at the upper end below opening 62. Between openings 64 and 70, there are three substantially equidistantly spaced bulb-shaped openings 72, 74 and 76. Each bulb-shaped opening 72, 74, and 76 includes a large diameter upper end opening portion 78 in open communication with a small diameter lower opening portion 80. There are also three small circular openings 82, 84 and 86 spaced along bar 60 as well as a small square opening 88 between openings 74 and 86. A bent tab 89 extends rearwardly from opening 88.

An elongated flat slide bar 90 is positioned parallel to and immediately behind stationary bar 60. Slide bar 90 includes a bent push tab 91 at its upper end which extends through square opening 70. Slide bar 90 further includes three oval-shaped openings 92, 94 and 96, which have the same general spacing as openings 82, 84 and 86. A rivet 98 extends through openings 82 and 92 and is locked thereto by a lock nut 100. In like manner, a rivet 102 extends through openings 84 and 94 and is locked therein by a lock nut 104. Lastly, a rivet 106 extends through openings 86 and 96 and is locked thereto by a lock nut 108. In this manner, since openings 92, 94 and 96 are elongated, slide bar 90 is permitted to move vertically relative to stationary bar 60, being held thereto by rivets 98, 102 and 106.

Slide bar 90 further includes three substantially equally spaced bulb-shaped openings 110, 112 and 114. Each bulb-shaped opening 110, 112 and 114 includes a large diameter upper opening portion 116 which has a diameter substantially the same as the diameter of large upper opening portion 78 for alignment therewith, and a narrow, elongated lower guide opening portion 118 in communication with upper opening portion 116.

Lastly, slide bar 90 includes an elongated opening 120 between openings 96 and 112 with a bent tab 122 at the lower end thereof. A coil spring 124 has one end connected to lower bent tab 122 and its upper end connected to bent tab 89 of stationary bar 60. In this manner, spring 124 normally biases slide bar 90 upwardly such that push tab 91 is stopped at the upper edge of upper square opening 70 of stationary bar 60. In this position, large diameter upper end opening portion 78 and large diameter upper opening portion 116 are out of alignment with each other.

Figures 22, 23:
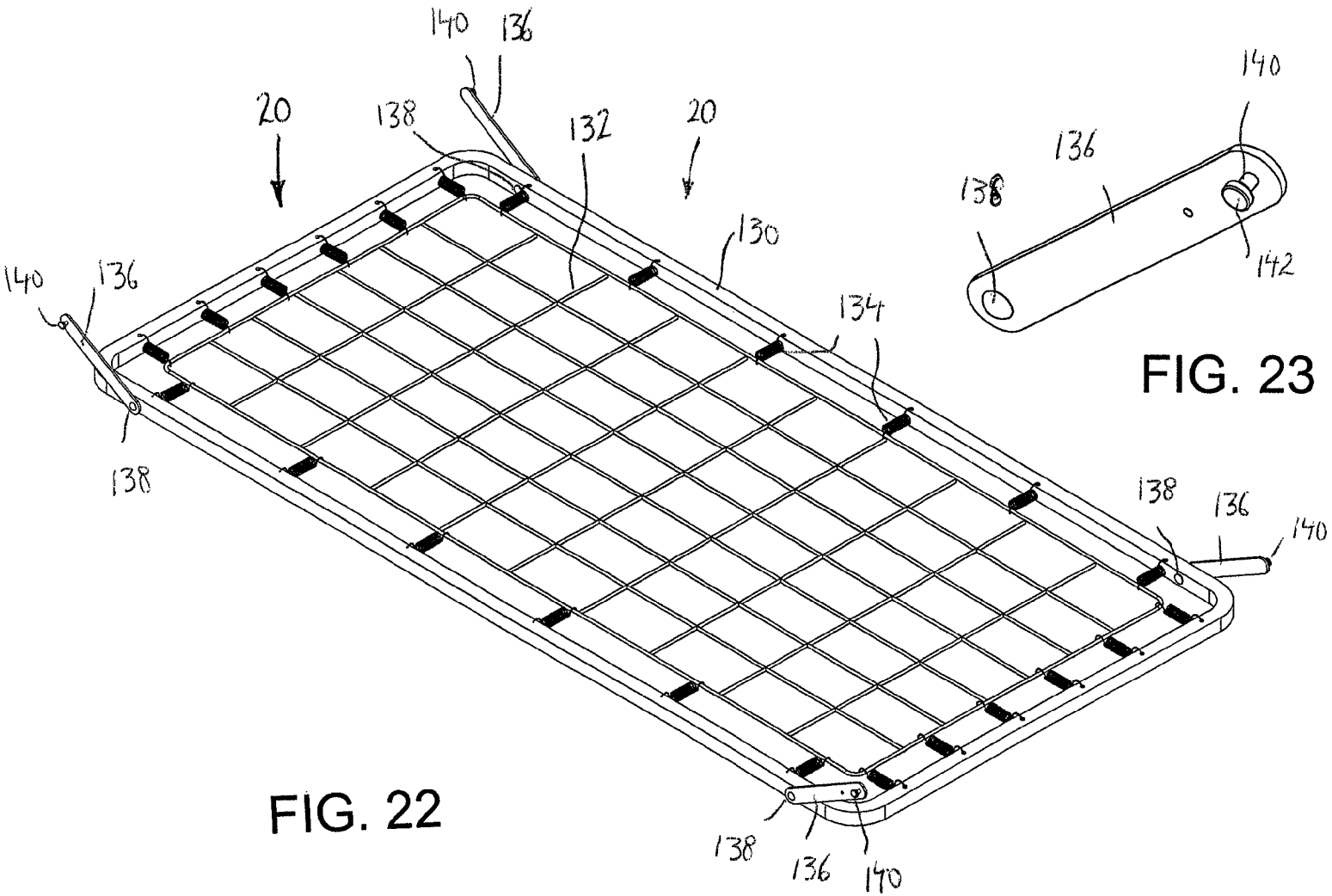
FIG. 22 is a perspective view of the spring deck.
FIG. 23 is a perspective view of one spring deck arm.

As shown in FIGS. 22 and 23, spring deck 20 for supporting a mattress thereon includes a rectangular metal frame 130 having an inner wire lattice 132 positioned within frame 130 and secured thereto by a plurality of springs 134. However, the present invention is not limited to this particular spring deck and any other suitable spring deck or mattress support can be used in place thereof.

Figure 29:
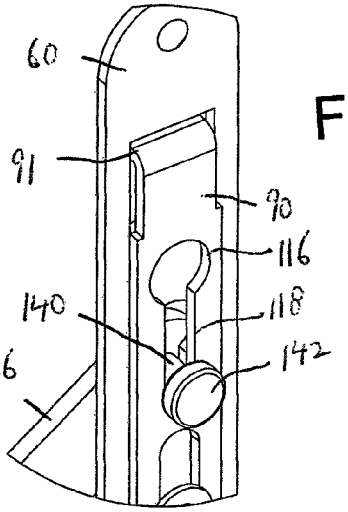
FIG. 29 is an enlarged rear perspective view of the upper end of the arrangement for securing the spring deck to the crib, with the push tab released.
Figure 27:
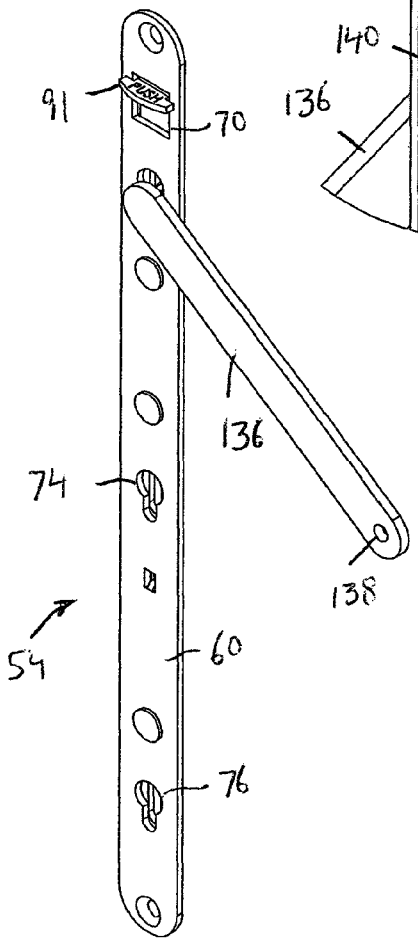
FIG. 27 is a front perspective view of the arrangement for securing the spring deck to the crib, with the push tab released.
Figure 28:
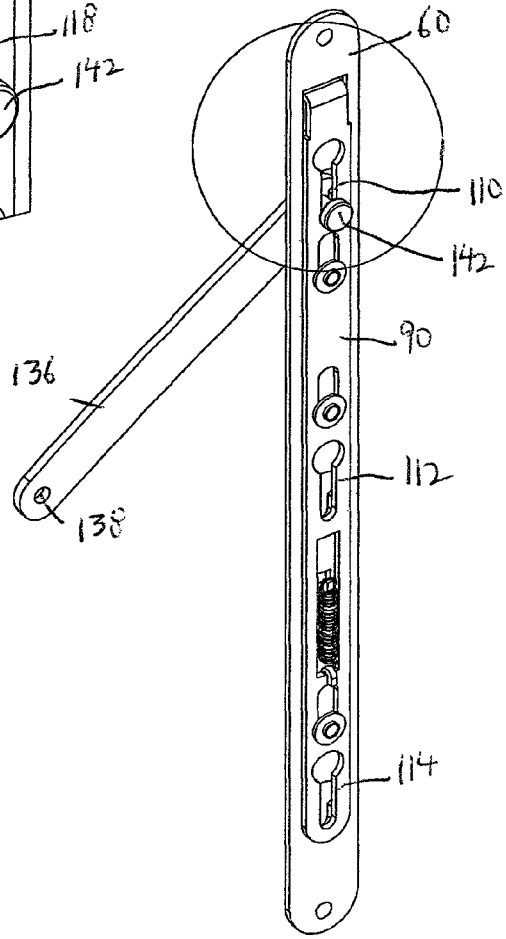
FIG. 28 is a rear perspective view of the arrangement for securing the spring deck to the crib, with the push tab released.

Four spring deck hanger arms 136 are pivotally connected to the ends of the longer sides of frame 130 of spring deck 100 by rivets 138. The outwardly facing free upper end of each spring deck hanger arm 136 includes a pin 140 with an enlarged head 142. As shown best in FIGS. 24-26, in order to assemble spring deck 20 with crib 10, push tab 91 is pushed down, such that large diameter upper end opening portion 78 and large diameter upper opening portion 116 are in alignment with each other for receiving enlarged head 142 of a pin 140 therein. This can be placed in any of openings 72, 74 or 76, depending on the height desired. The pushing down of push tab 91 causes slide bar 90 to move downwardly against the force of coil spring 124. After enlarged head 142 is positioned through upper opening portions 78 and 116, push tab 91 is released, whereby spring 124 causes slide bar 90 to move upwardly to the position shown in FIGS. 27-29. At this time, pin 140 slides within small diameter lower opening portion 80 and lower guide opening portion 118, and is thereby locked therein to prevent escape.

As a result, the present invention provides a spring deck holder 20 that does not require the use of any screws for assembly.

It will be appreciated, however, that various modifications within the scope of the present claims can be provided. For example, openings 110, 112 and 114 can be provided merely with large diameter upper opening portion 116 and can be normally spring biased downwardly. In such case, when slide bar 90 is raised up against the force of the spring, large diameter upper opening portion 116 and large diameter upper end opening portion 78 would be in alignment to receive the enlarged head 142 of pin 140. When released, slide bar 90 would be forced down. This would result in enlarged head 142 being carried by large diameter upper opening portion 116 into small diameter lower opening portion 80 to lock enlarged head 142 thereat.

Further, although spring 124 is provided for biasing slide bar 90 relative to stationary bar 60, spring 124 can be eliminated, and slide bar 90 can merely be releasably locked in a first position in which large diameter upper end opening portion 78 and large diameter upper opening portion 116 are in alignment with each other and a second position in which large diameter upper end opening portion 78 and large diameter upper opening portion 116 are out of alignment with each other. In such case, for example, achievement of the second out of alignment position can be achieved by gravity acting on slide bar 90, with movement to the first in alignment position being achieved by finger pressure.

As a further alternative, stationary bar 60 and slide bar 90 need not be secured together at all, and in such case, rivets 98, 102, 106 can be eliminated. Instead, for example, shallow recess 68 would be replaced by a double countersink, that is, a first recess, for example, one inch deep that would receive slide bar 90, and a second recess, for example, one-half inch deep superposed on the first recess and that would receive stationary bar 60. In such case, securement of stationary bar 60 by screws 66 would result in slide bar 90 being retained behind stationary bar 60 in the first recess. In such case, a spring can be provided at the bottom of slide bar 90 to push slide bar 90 up, but this spring need not be attached to stationary bar 60.

Having described a specific preferred embodiment of the invention with reference to the accompanying drawings, it will be appreciated that the present invention is not limited to that precise embodiment and that various changes and modifications can be effected therein by one of ordinary skill in the art without departing from the scope or spirit of the invention as defined by the appended claims.

What is claimed is:

1. A connecting arrangement for connecting a mattress support to supporting sides of a crib, comprising a plurality of elements:

a plurality of stationary bars secured to a plurality of the supporting sides, respectively, each stationary bar having a first opening;

a plurality of slide bars, each slide bar having a second opening and each slide bar being mounted in sliding relation to a respective said stationary bar between a first position in which the first and second openings are in alignment with each other and a second position in which the first and second openings are out of alignment with each other;

a third opening in one of a respective said stationary bar and slide bar and being in open communication with a respective one of said first and second openings, said third opening being smaller than the respective one of said first and second opening and being in alignment with the other of said respective one of said first and second openings in said second position;

a plurality of arms, each arm having one end connected to the mattress support and an opposite free end having a pin with an engaging end for engagement within respective said first and second openings when the respective said slide bar is moved to said first position and which is locked in said third opening when the respective said slide bar is moved to said second position;

a spring connected between each respective said stationary bar and slide bar for biasing each slide bar to the second position to lock said engaging end of said pin into one said third opening and the other of said respective one of said first and second openings, said spring being the only element connected to the slide bar and movable relative to the slide bar for moving said slide bar;

each of said stationary bars and slide bars extending in a lengthwise direction; and each said slide bar including an accessible tab for moving said slide bar and accessible tab together in said lengthwise direction relative to the respective said stationary bar by pressure applied on said tab in said lengthwise direction.

2. A connecting arrangement according to claim 1, wherein said third opening is provided in said slide bar in open communication with said second opening.

3. A connecting arrangement according to claim 1, wherein there are a plurality of said first openings in each stationary bar, and a plurality of said second openings in each slide bar, with a plurality of said third openings, each third opening in open communication with a respective one of said first and second openings.

4. A connecting arrangement according to claim 1, further including a fourth opening in the other of a respective said stationary bar and slide bar and being in open communication with the respective other of said first and second openings, said fourth opening being smaller than the respective other of said first and second openings.

5. A connecting arrangement according to claim 1, further including a securement assembly which secures together each said respective stationary bar and slide bar in a manner to permit each said slide bar to move in a sliding relation to the respective said stationary bar.

6. A connecting arrangement according to claim 5, wherein said securement assembly includes at least one elongated slot in one of said stationary bar and slide bar, and a rivet which is secured to the other of said stationary bar and slide bar and extends into the at least one elongated slot in said one of said stationary bar and slide bar.

7. A connecting arrangement according to claim 1, wherein said one end of each said arm is pivotally connected to the mattress support.

8. A connecting arrangement according to claim 1, wherein each said stationary bar includes a fourth opening, and said tab of the respective said slide bar extends through said fourth opening.

9. A connecting arrangement according to claim 1, wherein each said slide bar is positioned behind the respective said stationary bar.

10. A connecting arrangement according to claim 1, wherein the accessible tab is accessible by a person's finger for moving said slide bar and accessible tab together in said lengthwise direction relative to the respective said stationary bar by finger pressure applied on said tab in said lengthwise direction.

11. A crib comprising:

a headboard;

a footboard;

first and second side rails connected in parallel, spaced apart relation between said headboard and said footboard;

four vertical posts for supporting the crib and connected to four corners of the crib at interconnections of said footboard and headboard with said side rails;

a mattress support for supporting a mattress between the headboard, footboard and side rails;

a connecting arrangement for connecting the mattress support to the four vertical posts, said connecting arrangement including a plurality of elements:

a plurality of stationary bars secured to the vertical posts, respectively, each stationary bar having a first opening;

a plurality of slide bars, each slide bar having a second opening and each slide bar being mounted in sliding relation to a respective said stationary bar between a first position in which the first and second openings are in alignment with each other and a second position in which the first and second openings are out of alignment with each other;

a third opening in one of a respective said stationary bar and slide bar and being in open communication with a respective one of said first and second openings, said third opening being smaller than the respective one of said first and second openings and being in alignment with the other of said respective one of said first and second openings in said second position;

a plurality of arms, each arm having one end connected to the mattress support and an opposite free end having a pin with an engaging end for engagement within respective said first and second openings when the respective said slide bar is moved to said first position and which is locked in said third opening when the respective said slide bar is moved to said second position;

a spring connected between each respective said stationary bar and slide bar for biasing each slide bar to the second position to lock said engaging end of said pin into one said third opening and the other of said respective one of said first and second openings, said spring being the only element connected to the slide bar and movable relative to the slide bar for moving said slide bar;

each of said stationary bars and slide bars extending in a lengthwise direction; and each said slide bar including an accessible tab for moving said slide bar and accessible tab together in said lengthwise direction relative to the respective said stationary bar by pressure applied on said tab in said lengthwise direction.

12. A crib according to claim 11, wherein said third opening is provided in said slide bar in open communication with said second opening.

13. A crib according to claim 11, wherein there are a plurality of said first openings in each stationary bar, and a plurality of said second openings in each slide bar, with a plurality of said third openings, each third opening in open communication with a respective one of said first and second openings.

14. A connecting arrangement according to claim 11, further including a fourth opening in the other of a respective said stationary bar and slide bar and being in open communication with the respective other of said first and second openings, said fourth opening being smaller than the respective other of said first and second openings.

15. A crib according to claim 11, further including a securement assembly which secures together each said respective stationary bar and slide bar in a manner to permit each said slide bar to move in a sliding relation to the respective said stationary bar.

16. A crib according to claim 15, wherein said securement assembly includes at least one elongated slot in one of said stationary bar and slide bar, and a rivet which is secured to the other of said stationary bar and slide bar and extends into the at least one elongated slot in one of said stationary bar and slide bar.

17. A crib according to claim 11, wherein said one end of each said arm is pivotally connected to the mattress support.

18. A crib according to claim 11, wherein each said stationary bar includes a fourth opening, and said tab of the respective said slide bar extends through said fourth opening.

19. A crib according to claim 11, wherein each said slide bar is positioned behind the respective said stationary bar.

20. A crib according to claim 11, wherein the accessible tab is accessible by a person's finger for moving said slide bar and accessible tab together in said lengthwise direction relative to the respective said stationary bar by finger pressure applied on said tab in said lengthwise direction.

* * * * *